US007486239B1

(12) United States Patent
Channabasappa

(10) Patent No.: US 7,486,239 B1
(45) Date of Patent: Feb. 3, 2009

(54) MULTI-POLARIZATION PLANAR ANTENNA

(76) Inventor: Eswarappa Channabasappa, 1 Oxbow Dr., Acton, MA (US) 01720

( * ) Notice: Subject to any disclaimer, the term of this patent is extended or adjusted under 35 U.S.C. 154(b) by 0 days.

(21) Appl. No.: 11/862,627

(22) Filed: Sep. 27, 2007

(51) Int. Cl.
*H01Q 1/38* (2006.01)

(52) U.S. Cl. ..... 343/700 MS

(58) Field of Classification Search ..... 343/700 MS
See application file for complete search history.

(56) References Cited

U.S. PATENT DOCUMENTS 5,173,711 A * 12/1992 Takeuchi et al. ..... 343/700 MS
5,661,494 A * 8/1997 Bondyopadhyay ... 343/700 MS
6,906,674 B2 6/2005 McKinzie, III et al.
7,307,587 B2 * 12/2007 Eom et al. ..... 343/700 MS

OTHER PUBLICATIONS

A. A. Serra, P. Nepa, G. Manara, Fellow, IEEE, G. Tribellini, and S. Cioci, A Wide-Band Dual-Polarized Stacked Patch Antenna, IEEE Antennas and Wireless Propagation Letters, vol. 6, 2007, pp. 141-143.

Andrea Vallecchi and Guido Biffi Gentili, Design a Dual-Polarized Series-Fed Microstrip Arrays With Low Losses and High Polarization Purity, IEEE Transactions on Antennas and Propagation, vol. 53, No. 5, May 2005, pp. 1791-1798.

Hang, Wong, Member, IEEE, Ka-Leung Lau, and Kwai-Man Luk, Fellow, Design of Dual-Polarized L-Probe Patch Antenna Arrays With High Isolation, IEEE, IEEE Transactions on Antennas and Propagation, vol. 52, No. 1, Jan. 2004, pp. 45-52.

Kin-Lu Wong and Tzung-Wern Chiou, Finite Ground Plane Effects on Broad-Band Dual Polarized Patch Antenna Properties, IEEE Transactions on Antennas and Propagation, vol. 51, No. 4, Apr. 2003, pp. 903-904.

* cited by examiner

*Primary Examiner*—Trinh V Dinh
*Assistant Examiner*—Dieu Hien T Duong
(74) *Attorney, Agent, or Firm*—Saul Ewing LLP; Theodore Naccarella

(57) ABSTRACT

A dual polarization planar antenna comprising a first layer comprising a first patch, a second layer beneath the first layer comprising a first feed line for coupling a first signal to the first patch and a second feed line for coupling a second signal to the first patch such that the first patch radiates a field that has two different polarizations, and a third layer comprising first and second coupling discs electrically connected to the first feed line and third and fourth coupling discs electrically connected to the second feed line, wherein the first and second discs are electrically coupled to each other by a first half wavelength conductor and the third and fourth discs are electrically coupled the each other by a second half wavelength conductor, the first and second half wavelength conductors not being disposed in the second layer.

18 Claims, 7 Drawing Sheets

MULTI-POLARIZATION PLANAR ANTENNA

FIELD THE INVENTION

The invention pertains to antenna configurations. More particularly, the invention pertains to planar antennas with multiple polarizations.

BACKGROUND OF THE INVENTION

Planar patch antennas for RF (radio frequency) reception and/or transmission are becoming increasingly popular because of their small size and other useful attributes. However, they do have some drawbacks, such as relatively narrow bandwidth. Hence, techniques have been and continue to be developed to increase the bandwidth of such antennas. For instance, multiple patches of different sizes layered together can increase bandwidth. More recently, the use of an L-shaped probe instead of a conventional strip line or microstrip feed mechanism has been used to increase the bandwidth of planar patch antennas. H. Wong, L. Lau, and K. Luk, "The design of dual-polarized L-probe patch antenna arrays with high isolation", IEEE transactions on antennas and propagation, volume 52, number 1, January 2004. This reference discusses a dual polarization antenna utilizing two L-shaped probes oriented orthogonally to each other in order to feed a single patch. The authors claim that a 20% or greater bandwidth can be obtained with this design.

However, the use of two orthogonal L-probes suffers from at least two significant deficiencies. First, it has a poor isolation between the two ports (i.e., between the two polarizations). That is, there can be significant coupling between the two ports such that signal on the first feed line of the first polarization pollutes the signal of the other polarization on the other feed line. Second, it has poor cross polarization properties. The isolation and cross-polarization levels could be as high as −10 dB. Typically, for good performance of radars, the isolation and cross-polarization levels should be on the order of −20 dB. Specifically, when two L-probes (or any other feed mechanisms, for that matter) are oriented orthogonally to each other, ideally, there should be no cross polarization between the two probes. Particularly, the E field of each probe should be parallel to the probe and, therefore, the E field of one probe should have no effective field strength at the other probe because the other probe is orthogonal thereto. However, in practice, this has proven to be far from true.

In the aforementioned paper, Wong et al. propose one solution to help increase isolation involving the use of the balanced L-probes. Id. According to this solution, instead of using a single L-probe per polarization, two L-probes oriented in opposing directions and fed with signals 180° phase shifted relative to each other are used to feed each polarization. The feed network is rather complex in order to feed each of the two L-probes associated with each polarization with the same basic signal, but 180° out of phase there with. This is achieved by branching the feed line into two lines, one of the branches being a half wavelength longer than the other branch.

This design has been found to provide substantial benefits in terms of increased isolation and, often, decreased cross-polarization. But the major disadvantage is that it requires a very complex feed network in the feed network layer of the planar antenna. Furthermore, when the feed network is microstrip, there is distortion in the antenna radiation patterns and increased cross-polarization levels.

A complex feed network is extremely disadvantageous, particularly in antenna arrays, because there often is a need or desire to place additional circuitry in this layer, such as RF transmission lines, DC lines, control lines, etc. Specifically, these lines often need to be placed in the same layer as the feed network between two ground planes in order to isolate the signals on those lines from the radiating (or receiving) patches of the antenna.

It also is known in the prior art to use disc coupling, instead of L-probe coupling. In these types of systems, instead of using an L-shaped probe, the feed network is coupled to one or more disc shape probes that capacitively couple to the patches.

SUMMARY OF THE INVENTION

A dual polarization planar antenna comprising a first layer comprising a first patch, a second layer beneath the first layer comprising a first feed line for coupling a first signal to the first patch and a second feed line for coupling a second signal to the first patch such that the first patch radiates a field that has two different polarizations, and a third layer comprising first and second coupling discs electrically connected to the first feed line and third and fourth coupling discs electrically connected to the second feed line, wherein the first and second discs are electrically coupled to each other by a first half wavelength conductor and the third and fourth discs are electrically coupled the each other by a second half wavelength conductor, the first and second half wavelength conductors not being disposed in the second layer.

DETAILED DESCRIPTION OF THE INVENTION

In accordance with the present invention, a multi-layer feed network is provided in order to provide a balanced feed network while keeping the strip line layer of the antenna very simple.

Figure 1:
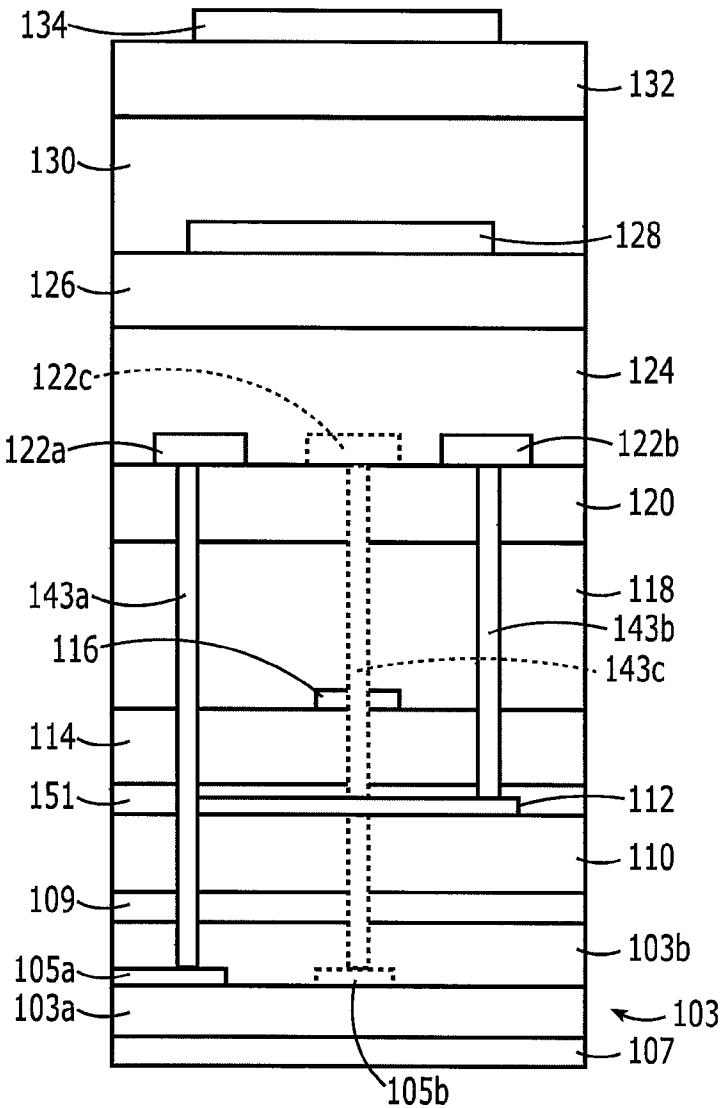
FIG. 1 is a cross-sectional side view of a wideband, low cross-polarization planar antenna in accordance with a first embodiment of the invention.
Figure 2:
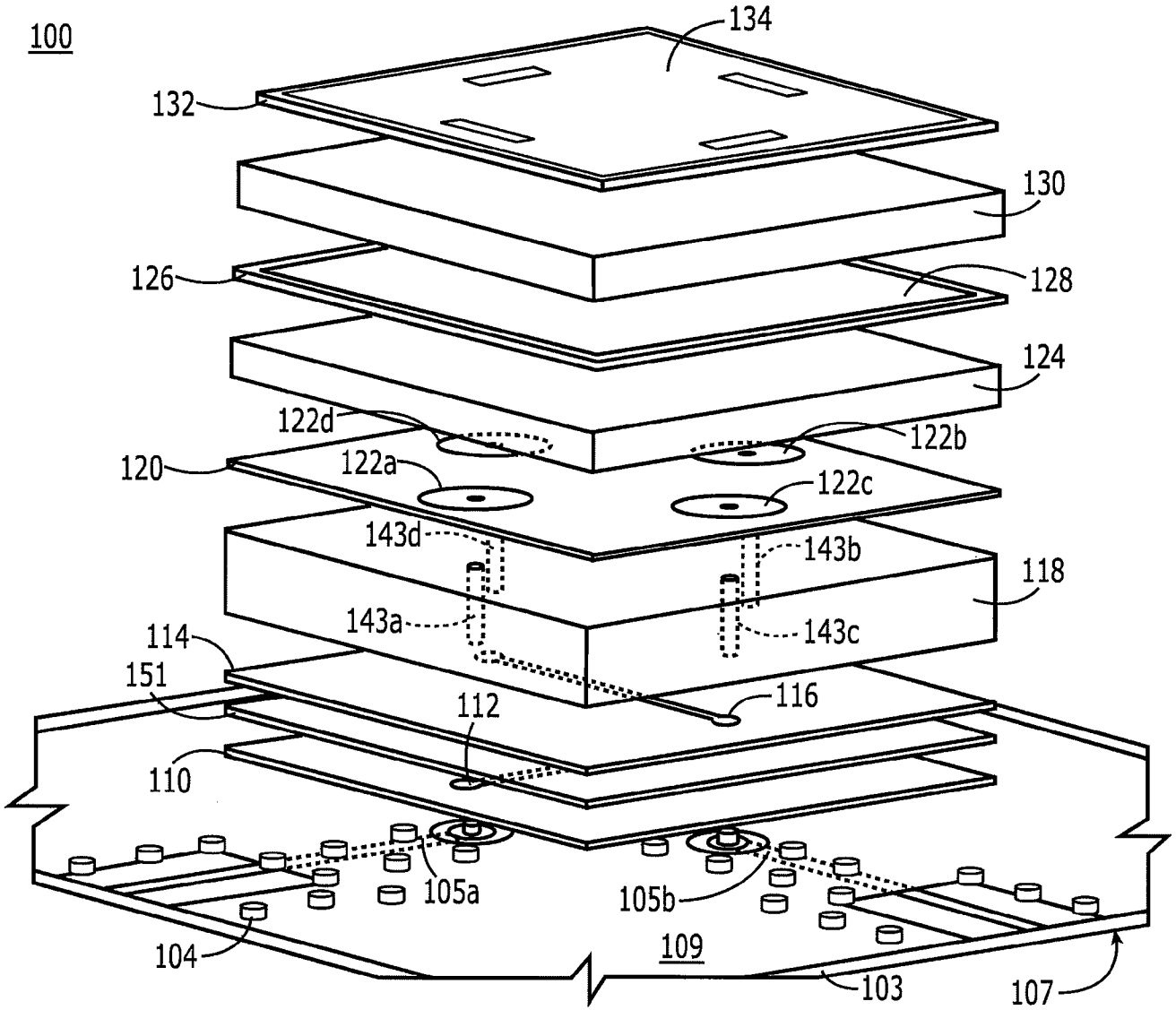
FIG. 2 is an exploded perspective view of the antenna of FIG. 1.
Figure 3:
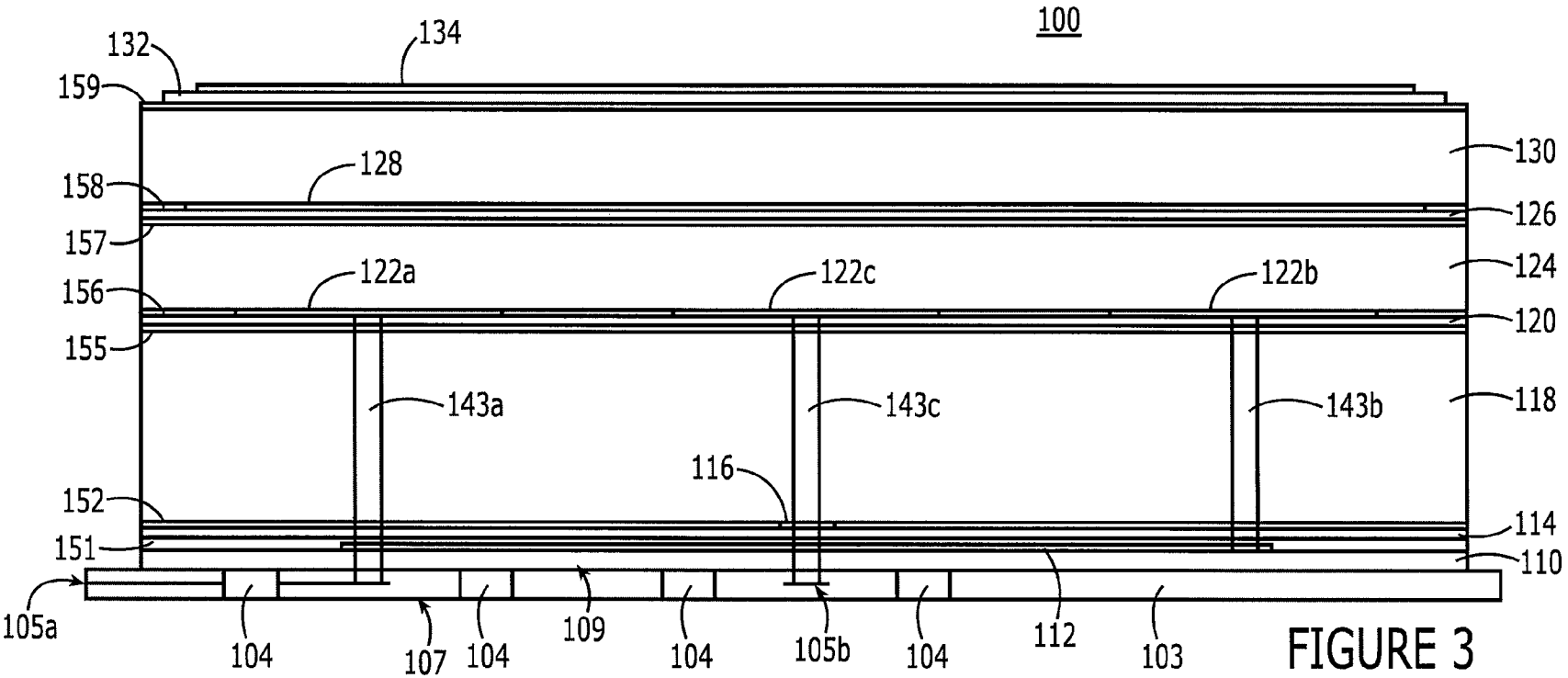
FIG. 3 is a semi-transparent side view of the antenna of FIG. 1.
Figure 4:
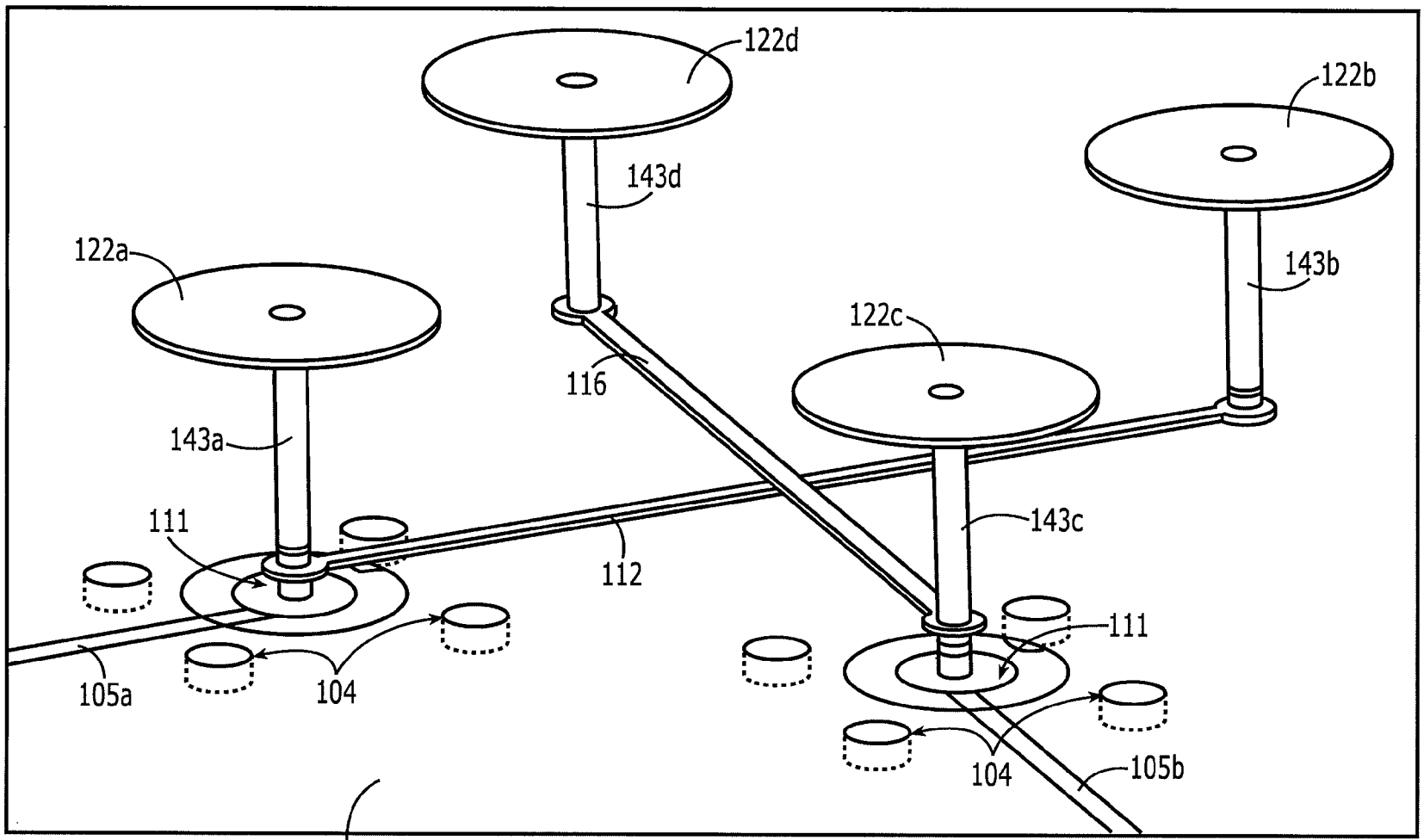
FIG. 4 is a perspective view of the discs and connecting transmission lines of the embodiment of FIG. 1 disembodied from the remainder of the antenna structure.

FIGS. 1-4 illustrate a first embodiment 100 of the invention. FIG. 1 is a primarily cross-sectional side view of the various layers of the antenna 100, FIG. 2 is an exploded perspective view of the various layers, FIG. 3 is a semi-transparent side view of the antenna 100, and FIG. 4 is a semi-transparent perspective view of the feed network portions of the overall antenna structure. Only FIG. 3 shows all of the adhesive layers for sake of completeness. In order to simplify the diagrams, only one exemplary layer of adhesive (adhesive layer 151 between RF boards 110 and 114) is shown in FIGS. 1 and 2 and no adhesive layers are shown in FIG. 4. Also, for sake of clarity, some features are shown in the cross-sectional view of FIG. 1 that would not be visible in a true cross-sectional drawing because no single cross-section would capture all of the features. Therefore, those features that would not normally be visible in a true cross-section are shown with dashed lines (i.e., in phantom).

Some of the features are best seen in one or two particular drawing Figures, while others are best seen in other Figures. The following discussion, therefore, should be read in connection with all of FIGS. 1-4.

In accordance with the first illustrated embodiment of the invention, two orthogonal strip lines 105*a* and 105*b* are disposed in a strip line layer 103 sandwiched between two ground planes 107 and 109. In one embodiment of the invention, layer 103 comprises two pieces of flex board 103*a* and 103*b*, with the strip lines 105*a* and 105*b* formed on one surface of one of the flex boards and ground planes 107 and 109 formed on the outer surfaces of the flex boards 103*a* and 103*b* respectively. The two flex boards 103*a* and 103*b* are adhered or otherwise attached together with the strip lines in the middle. The two ground planes may be electrically coupled together by one or more vias 104.

Typically, the strip line layer 103 and the ground planes 107 and 109 will be much larger in area than the remaining layers in order to provide a very large ground plane beneath the radiating (or receiving) patches.

As can perhaps best be seen in FIGS. 2 and 3, the strip lines 105*a*, 105*b* are each straight conductors that run between an edge of the flex board 103*a* or 103*b* to one of the vias 143*a*, 143*b*, 143*c*, 143*d* that each connected to one of the discs 122*a*, 122*b*, 122*c*, 122*d* for each polarization. For instance, strip line 105*b* runs between an edge of the board 103*a* (where it can be connected to a signal source or signal destination) to via 143*c* that runs vertically from the strip line layer 103 to one of the discs 122*b*, as will be described in further detail below. Likewise, strip line 105*a* runs in a direction orthogonal to the direction of strip line 105*b* from an edge of the board 103*a* to via 143*a*, which connects to disc 122*b*.

The flex board may be any conventional flex board commonly used in the planar antenna design for strip line layers. In fact, the insulating layers need not be flex board at all and can be other insulating materials.

Above and adhered to the top ground plane 109 by adhesive layer 151 (with one exception, adhesive layers are shown only in FIG. 3) is an RF board 110. The RF board may be any conventional RF board material used in planar antenna design. In fact, it may be any material that is insulating and on which a conductor can be effectively disposed. In one embodiment of the invention, it is RO4003, RO4450, or Arlon 25N. It may also comprise a lamination of any of the above or any other available RF board materials.

A transmission line 112 is formed on the top surface of RF board 110. A first end of this transmission line is connected from a first via 143*a* (to which the end of the first strip line 105*a* is connected) to a second via 143*b*. Via 143*a* runs vertically through at least layers 103, 109, 110, 114, 118, and 120, from the strip line 105*a* to the disc 122*a* disposed on top of layer 120, as will be discussed in further detail below. A hole 111 (shown in FIG. 4) is formed in top ground plane 109 so that the ground plane does not electrically contact the conductive via 143*a*. Second via 143*b* runs vertically through at least layers 114, 118, and 120 between the transmission line 112 and the second disc 122*b* of the balanced disc pair 122*a*, 122*b*. The transmission line 112 length is one half wavelength of the center frequency of the antenna. Accordingly, the disc 122*a* is fed with the signal from stripline 105*a* at a given phase, e.g., 0°, and disc 122*b* is fed with the same signal, but 180° out of phase therewith.

Adhered on top of RF board 110 and transmission line 112 via adhesive layer 151 is another RF board 114 and another half wavelength transmission line 116. Transmission line 116 is parallel to strip line 105*b* and orthogonal to strip line 105*a* and transmission line 112. This transmission line runs between via 143*c* and via 143*d*. Via 143*c* runs vertically through layers 103, 109, 110, 114, 118, and 120 to connect transmission line 105*b* to disc 122*c*. Via 143*d* runs vertically through layers 118 and 120 to connect transmission line 116 to disc 122*d*. Accordingly, just as was the case with discs 122*a* and 122*b*, discs 122*c* and 122*d* are fed with the signal of the second polarization from stripline 105*b* with signals that are 180° out of phase with each other such that discs 122*c* and 122*d* also form a balanced polarization pair.

Adhered to the second RF board layer 114 and transmission line 116 by adhesive layer 152 is a foam spacer layer 118. Foam layer 118 can be formed of any foam material or other insulator suitable for use in connection with the planar antennas or other RF applications. In fact, it can be air rather than foam or another insulator, if desired. Another RF board 120 is adhered via adhesive 155 to the top side of layer 118. The discs 120*a*, 122*b*, 122*c*, and 122*d* are formed on the top surface of RF board 120.

Above RF board 120 and discs 122*a*, 122*b*, 122*c*, 122*d* are the spacing and substrate layers and metallizations for the patch or patches. Specifically, in this example, next is another foam layer 124 adhered to the RF board 120 and discs 122*a*, 122*b*, 122*c*, 122*d* by adhesive layer 156, followed by a fourth RF board 126 adhered to the top of foam layer 124 by another adhesive layer 157. The first patch 128 is formed on the top side of RF board 126.

This forms a complete antenna. However, in accordance with preferred embodiment of the invention, a second patch is provided of slightly different size than the first patch in order to provide wider bandwidth of the antenna. Accordingly, in at least one embodiment of the invention, above the fourth RF board layer 126 and first patch 128 is another foam layer 130 with adhesive on both sides 158, 159, followed by another RF board 132 and a second patch 134.

In accordance with the configuration of FIGS. 1-4, a dual polarization planar antenna with a balanced feed network having wide bandwidth, low-cross polarization, and good isolation is provided. Furthermore, a complex feed network does not complicate the strip line layer 103 because the half wavelength transmission lines 112, 116 are not disposed in the strip line layer 103 between the two ground planes 107 and 109. The strip line layer simply comprises two orthogonal strip lines 105*a*, 105*b*, thus leaving space for any other circuitry or conductors that may be needed in this layer between the two ground planes 107 and 109.

Figure 5:
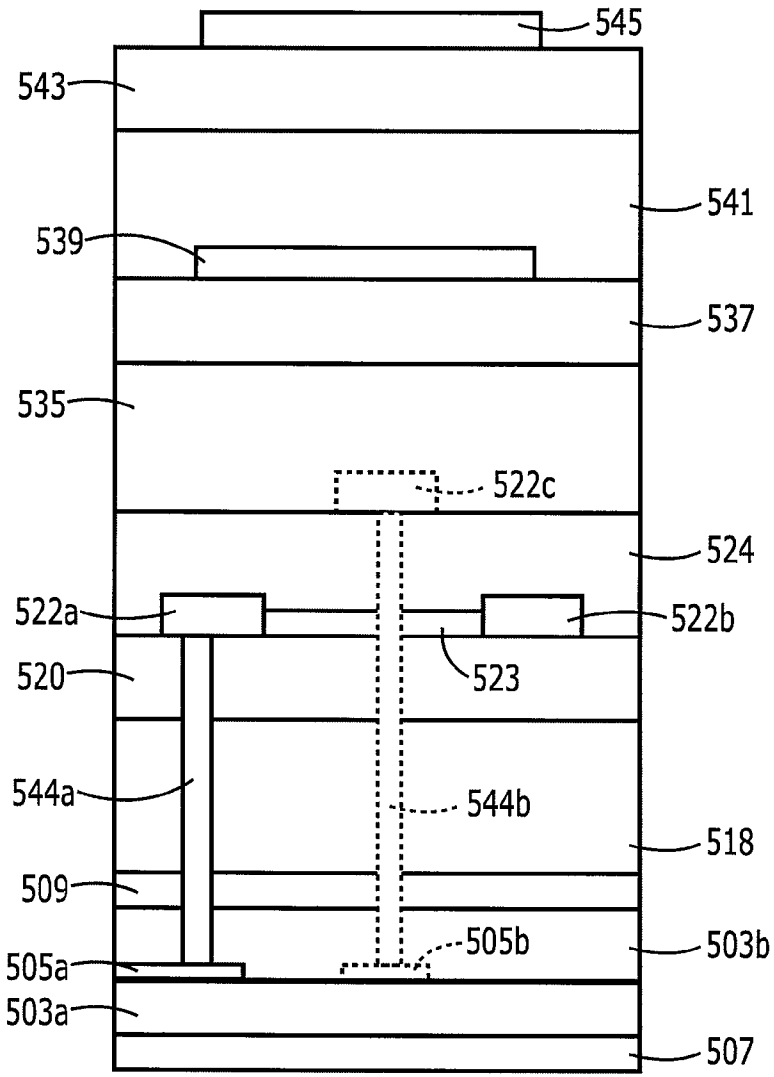
FIG. 5 is a cross-sectional side view of a wideband, low cross-polarization planar antenna in accordance with a second embodiment of the present invention.
Figure 6:
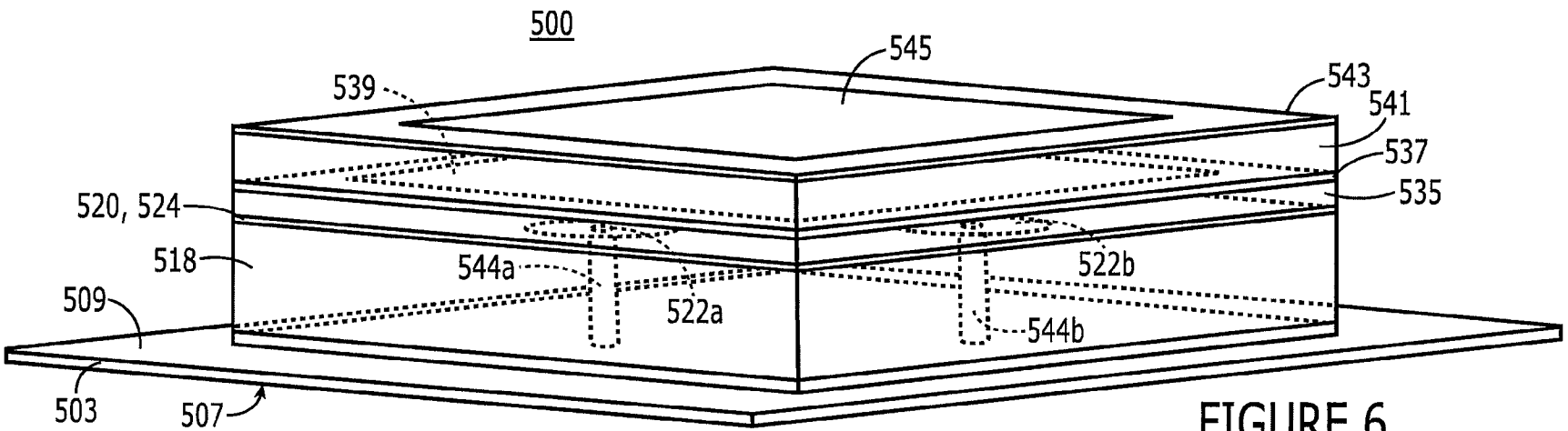
FIG. 6 is a semi-transparent perspective view of the antenna of FIG. 5.
Figure 7:
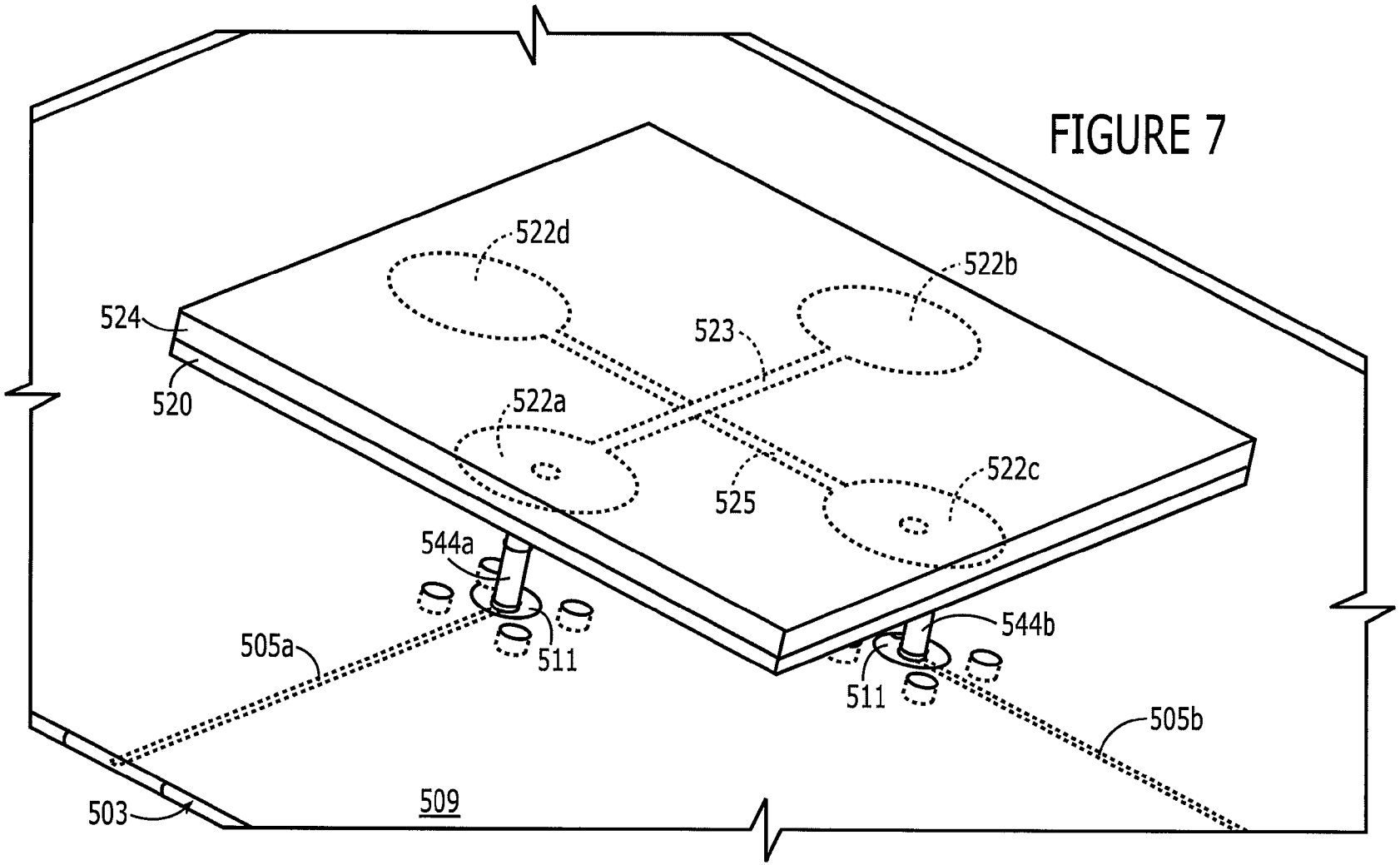
FIG. 7 is a semi transparent perspective view of selected portions of the antenna of FIG. 5 relating to the feed network disembodied from the remainder of the antenna structure.

FIGS. 5-7 illustrate a second embodiment of the invention. Particularly, FIG. 5 is a cross-sectional side view of a dual polarization planar antenna 500 in accordance with the second embodiment of the invention, FIG. 6 is a semi-transparent perspective view thereof, and FIG. 7 is a semi-transparent perspective view of the feed network portion of this antenna disembodied from the rest of the antenna structure.

In this embodiment, the ground plane and microstrip layers are essentially unchanged from the embodiment of FIGS. 1-4. Particularly, it comprises a flex board layer 503 comprising two flex boards 503*a* and 503*b* with two orthogonal striplines 505*a*, 505*b* formed on the surface of one of the flex boards. The two flex boards 503*a* and 503*b* are sandwiched together and have ground planes 507 and 509 formed on opposite sides thereof. Next is a foam layer 518 followed by an RF board layer 520. Two discs 522*a*, 522*b* are formed on the top side of RF board 520. A first conductive via 544*a* runs from the end of the first strip line 505*a* through the various layers up to disc 522*a*. A hole 511 is formed in top ground plane 509 so that the ground plane does not electrically contact the conductive via 544*a*. Accordingly, the first signal having the first polarization is provided to disc 522*a* through stripline 505*a* and via 544*a*. A transmission line 523 also is formed on the top surface of RF board 520 running between disc 522*a* and a second disc 522*b* of the balanced pair of discs 522*a*, 522*b*. This transmission line is one half wavelength long. Accordingly, the second disc 522*b* is fed with the same signal from stripline 505*a*, but 180° out of phase with the signal at disc 522*a*.

On top of RF board 520 and discs 522*a* and 522*b* is another RF board 524 and two more discs 522*c* and 522*d*.

A second conductive via 544*b* runs from the end of the second strip line 505*b* through the various layers up to disc 522*c*. A hole is formed in top ground plane 509 so that the ground plane does not electrically contact the conductive via 544*b*. Accordingly, the second signal having the second polarization is provided to disc 522*c* through microstrip 505*b* and via 544*b*. A second transmission line 525 is formed on the top surface of RF board 524 running between disc 522*c* and a second disc 522*d* of the balanced pair of discs 522*c*, 522*d*. This transmission also line is one half wavelength long. Accordingly, the second disc 522*d* on layer 524 is fed with the same signal from microstrip 505*c*, but 180° out of phase with the signal at first disc 522*c*.

Finally, the one or more patches are constructed on top of RF board 524 and patches 526*c* and 526*d*. Particularly, another foam layer 535 is followed by another RF board 537 on which the first patch 539 is formed. This is followed by another foam layer 541, followed by another RF board 543 and the second patch 545.

This embodiment operates on essentially the same principles as the first embodiment. However, it saves several layers by incorporating the half wavelength transmission lines into the layers of the discs. Particularly, in comparison to the embodiment of FIGS. 1-4, layers 110 and 114, including the transmission lines 112 and 116 have been eliminated. On the other hand, a second disc layer has been added compared to the embodiment of FIGS. 1-4. Particularly, whereas, in the embodiment of FIGS. 1-4, there was one RF board bearing all four discs, in this second embodiment, there are two RF boards, each bearing two of the four discs. Two insulating layers and the conductive structures formed thereon have been eliminated in connection with the transmission lines, but one insulating layer and its conductive structure has been added in connection with the disc layers. Accordingly, in this embodiment, there are two fewer layers band in the embodiment of FIGS. 1-4.

Having thus described a few particular embodiments of the invention, various alterations, modifications, and improvements will readily occur to those skilled in the art. Such alterations, modifications, and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

The invention claimed is:

1. A dual polarization planar antenna comprising:

a first layer comprising a first patch;

a second layer beneath the first layer comprising a first feed line for coupling a first signal to the first patch and a second feed line for coupling a second signal to the first patch such that the first patch radiates a field that has two different polarizations; and a third layer comprising first and second coupling discs electrically connected to the first feed line and third and fourth coupling discs electrically connected to the second feed line;

wherein the first and second discs are electrically coupled to each other by a first half wavelength conductor and the third and fourth discs are electrically coupled to each other by a second half wavelength conductor, the first and second half wavelength conductors not being disposed in the second layer.

2. The antenna of claim 1 further comprising fourth and fifth layers comprising a ground plane, the fourth and fifth layers sandwiching the second layer.

3. The antenna of claim 2 wherein the first and second half wavelength conductors comprise transmission lines and wherein the first and second half wavelength conductors are not between the fourth and fifth layers.

4. The antenna of claim 1 wherein the first and second half wavelength conductors are in the third layer.

5. The antenna of claim 4 wherein the third layer comprises a first sub-layer including the first and second discs and the first half wavelength conductor and a second sub-layer comprising the third and fourth discs and the second half wavelength conductor.

6. The antenna of claim 5 wherein the first and second discs and the first conductor are coplanar with each other and wherein the third and fourth discs and second conductor are coplanar with each other.

7. The antenna of claim 5 wherein the first disc is electrically coupled to the first feed line by a first conductive via extending between the second layer and the first sub layer of the third layer, and the third disc is electrically coupled to the second feed line by a second conductive via extending between the second layer and the second sub-layer of the third layer.

8. The antenna of claim 7 wherein each layer, including each sub-layer, further comprises an insulating material.

9. The antenna of claim 8 wherein the insulating material of each layer comprises at least RF board.

10. The antenna of claim 9 further comprising at least one layer of foam spacer.

11. The antenna of claim 1 further comprising:

a seventh layer comprising a second patch.

12. The antenna of claim 1 further comprising eighth and ninth layers, wherein the first half wavelength conductor is in the eighth layer and the second half wavelength conductor is in the ninth layer.

13. The antenna of claim 12 wherein the first disc is electrically coupled to the first feed line by a first conductive via extending between the second and third layers and wherein the first conductive line has a first end coupled to an intermediate point in the first conductive via and a second end coupled to a third conductive via extending between the eighth layer and the third layer and connected to the second disc, and wherein the second conductive line has a first end coupled to an intermediate point in the second conductive via and a second end coupled to a fourth conductive via extending between the ninth layer and the third layer and connected to the fourth disc.

14. The antenna of claim 13 wherein the eighth and ninth layers are disposed between the second and third layers.

15. The antenna of claim 1 wherein the first feed line and first conductor are parallel to each other and wherein the second feed line and second conductor are parallel to each other.

16. The antenna of claim 15 wherein the first feed line and first conductor are orthogonal to the second feed line and second conductor.

17. The antenna of claim 1 wherein the first and second feed lines comprise strip lines.

18. The antenna of claim 1 further comprising at least one insulating layer disposed between each of the first, second, and third layers.

* * * * *